United States Patent [19]

St. Clair et al.

[11] Patent Number: 4,635,066

[45] Date of Patent: Jan. 6, 1987

[54] MULTIBAND MULTIMODE AIRCRAFT ANTENNA

[75] Inventors: Gordon St. Clair, El Toro; Evert C. Alsenz, Newport Beach, both of Calif.

[73] Assignee: Avionics Antenna Systems, Huntington Beach, Calif.

[21] Appl. No.: 587,740

[22] Filed: Mar. 8, 1984

[51] Int. Cl.[4] ..... H01Q 1/28

[52] U.S. Cl. ..... 343/705; 343/725; 343/828

[58] Field of Search ..... 343/705, 708, 725, 729, 343/828, 853, 887

[56] References Cited

U.S. PATENT DOCUMENTS 2,555,857 6/1951 Nelson et al. ..... 343/705

*Primary Examiner*—Eli Lieberman

*Attorney, Agent, or Firm*—Knobbe, Martens, Olson & Bear

[57] ABSTRACT

The antenna of the invention is suitable for use with an aircraft and is capable of receiving a plurality of frequency ranges in the communication band and provides a directional antenna. To this end there is provided an upper wing element from which extend vertically two outer leg elements and a central leg element. The central leg element extends into a fairing disposed below and substantially coextensive with the wing element. Two symmetrical slots are disposed in the wing element symmetrically disposed about the central axis. Another slot extends through the central leg element and the fairing. The slots are provided with capacitors to provide antiresonant circuits at predetermined frequency ranges.

11 Claims, 8 Drawing Figures

MULTIBAND MULTIMODE AIRCRAFT ANTENNA

BACKGROUND OF THE INVENTION

This invention relates generally to antennas and more particularly to a multiband, multimode antenna which provides both a communication antenna section and a directional antenna section.

In the past it has been conventional practice to provide separate antennae for such purposes. Thus, there may be as many as three different communication antennas and two directional antenna portions to provide the capability of the antenna of the present invention. This antenna is specifically designed for use with aircraft; that is, with fixed-wing airplane and helicopter-type devices.

In this case, it is highly desirable that the over-all vertical height of the antenna be as small as possible. Antennas of this type are generally known; for example, Adcock Arrays. Such antennas may extend over a large area, which, however, is not available on aircraft.

Furthermore, it is known to increase the bandwidth of such an antenna by capacitive top-loading. Such a device will form a monopole antenna which is electrically short; that is, less than one-fourth wavelength. However, in the past, the use of capacitive top-loading has not been used for aircraft antennas because of the bulk required for top-loading.

It is, accordingly, an object of the present invention to provide a top-loaded monopole antenna suitable for use with aircraft.

Another object of the invention is to provide a single antenna structure capable of receiving and transmitting for communication purposes, three frequency bands in the megahertz region.

A further object of the present invention is to provide such an antenna which cooperates with two wires for providing a directional antenna system which may be used for homing purposes.

SUMMARY OF THE INVENTION

In accordance with the present invention there is provided a multiband, multimode antenna suitable for use with an aircraft. The antenna comprises an upper wing element, a central leg element mechanically connected to the wing element and a fairing which extends below the wing element. The wing and central elements and the fairing constitute a monopole antenna section.

There is further provided a first and a second outer leg element which are equally spaced from the central leg element and mechanically connected to the wing element. The outer leg elements, in conjunction with the central leg element, constitute a directional antenna section.

All of the elements consist of an insulating material. An electrically conductive coating, such as a copper coating, is applied to the outer surface of the central leg element and the wing elements, as well as to the fairing. In this manner the elements and fairing are electrically connected except for the bottom area of the central leg element and the fairing for insulation from the ground plane.

The outer leg elements are each provided with an internal electrically conductive wire. The central leg element reflects electromagnetic radiation to the outer leg elements to enhance the reception for the directional antenna section.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENT

Figure 1:
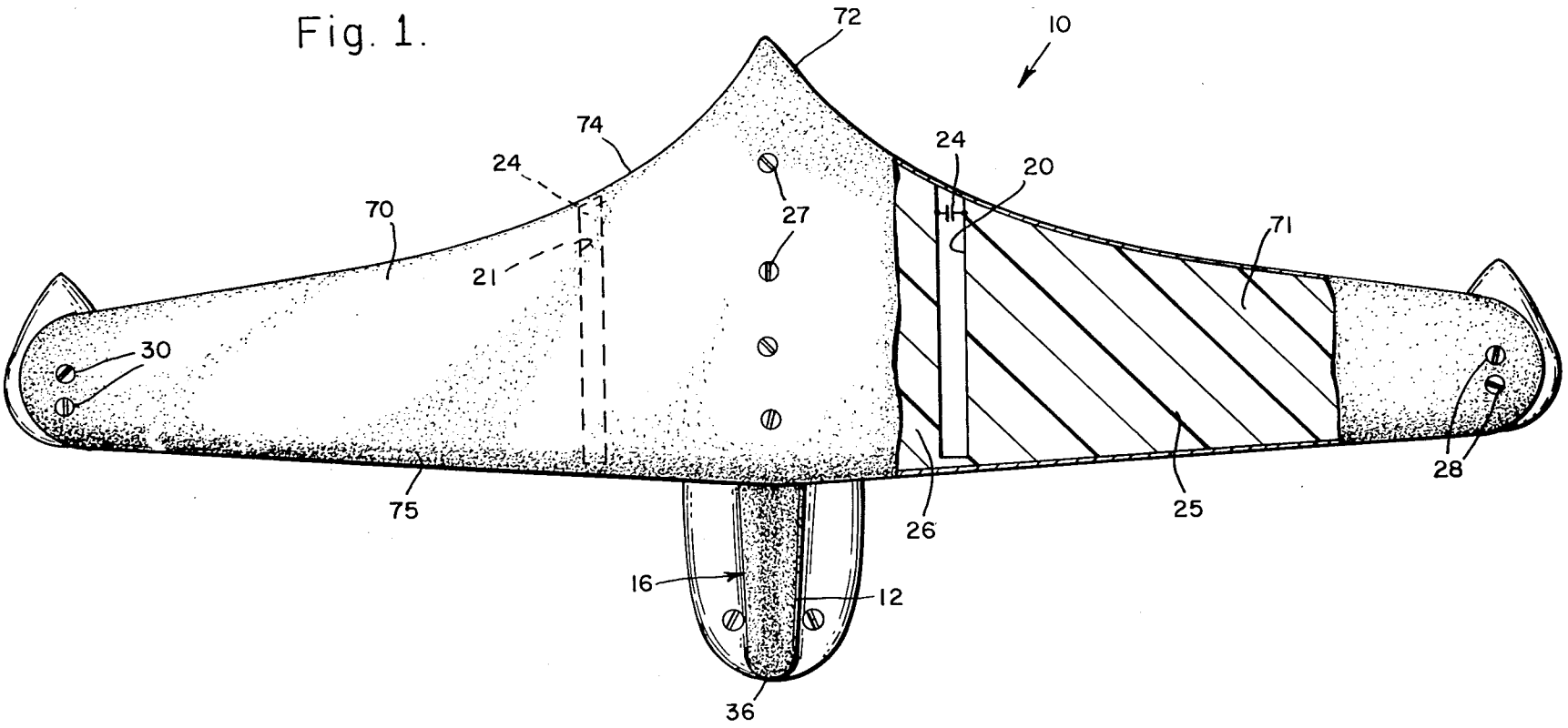
FIG. 1 is a top plan view of the antenna of the invention.
Figure 2:
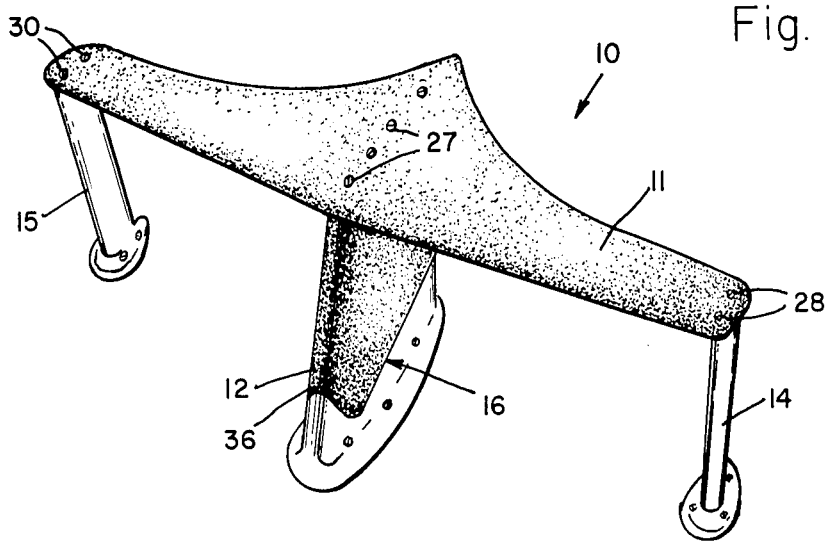
FIG. 2 is a perspective view of the antenna showing particularly the fairing below the outer wing section.
Figure 3:
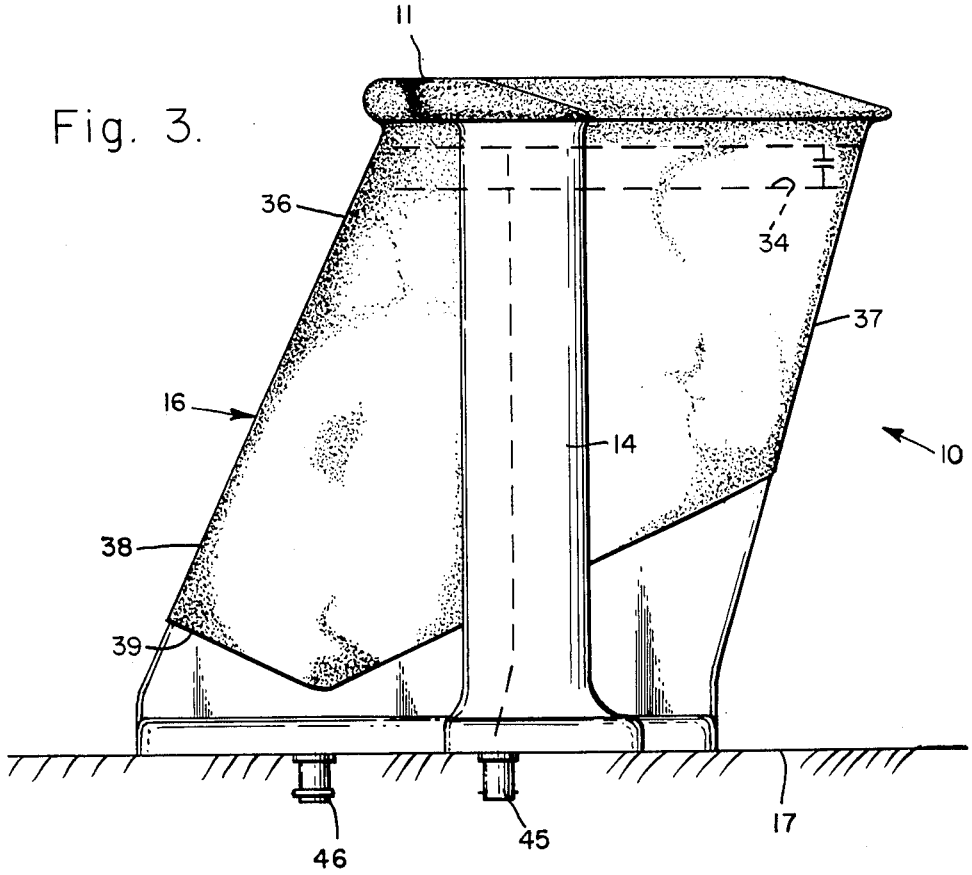
FIG. 3 is a side elevational view of the antenna of FIG. 1.

Referring now to the drawings and particularly to FIGS. 1 through 4, there is illustrated the multiband, multimode antenna 10 of the present invention. The antenna includes an upper wing element 11 which may have any desirable shape, the exact shape being of small importance. However, the upper wing element 11, as shown in FIG. 1, is provided with two wing sections 70 and 71, as well as with a forwardly protruding nose 72. The entire wing element 11 has a trailing edge 75 and a leading edge 74.

Figure 4:
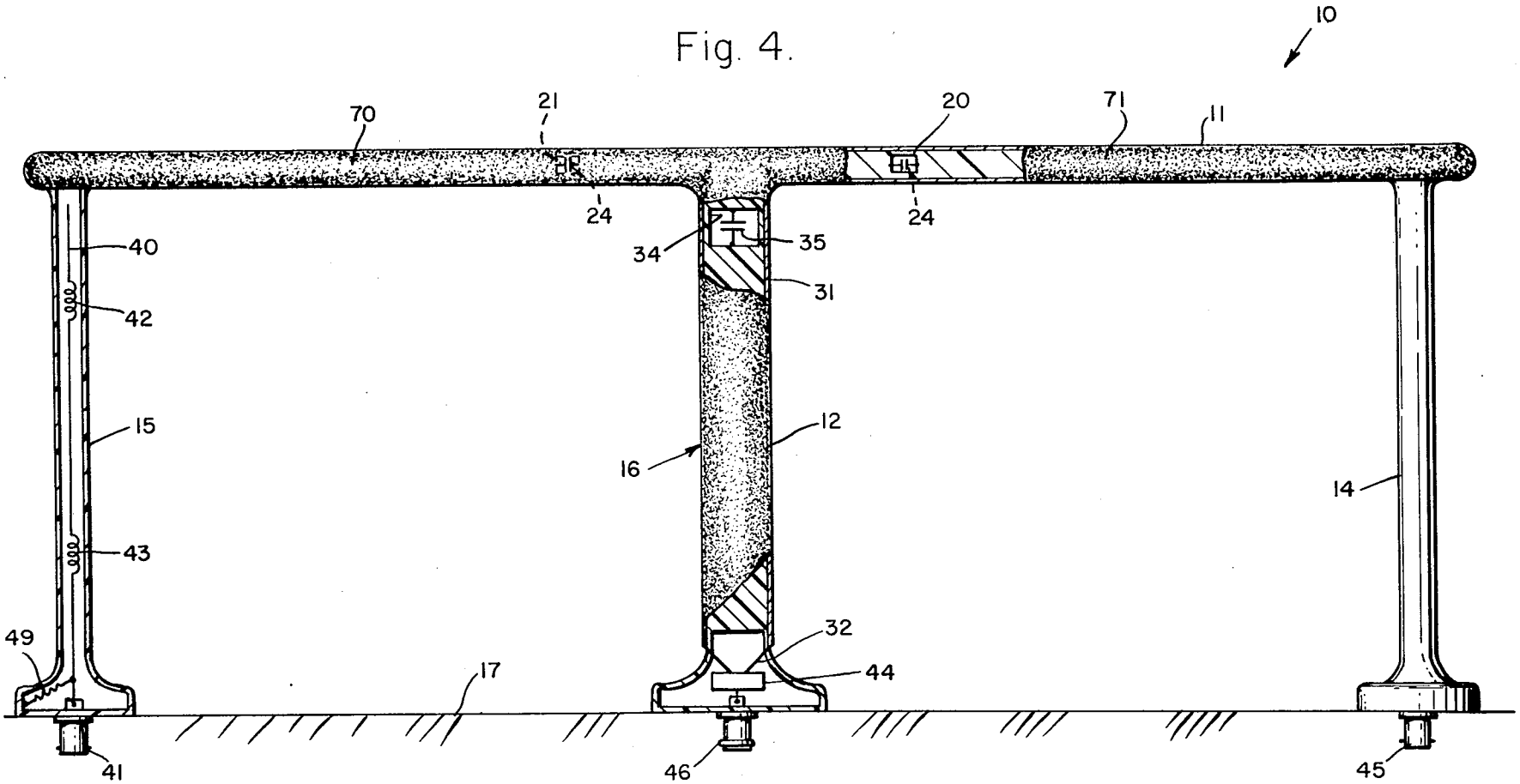
FIG. 4 is a front elevational view showing the three leg elements and the outer wing element.

As shown particularly in FIG. 4, there is a central leg element 12 and two outer leg elements 14 and 15. The two outer leg elements 14 and 15 are symmetrically spaced about the central leg element 12 and all leg elements are mechanically connected to the upper wing element 11. Extending below the wing element 11 is a fairing 16, partially shown in FIG. 1 and particularly in FIGS. 2 and 3. The antenna is mounted on a ground plane 17 which may, for example, be the metal surface of an aircraft.

The wing element 11 is provided with two wing slots 20 and 21 which are symmetrically located about the central axis of the wing element 11. The two slots extend up to the leading edge 74 of the wing element but stop short on the trailing edge 75 thereof. A capacitor 24 is connected across the slot 20 near its upper end. The capacitor, in conjunction with the slot, provides an antiresonant circuit; that is, a parallel resonant circuit. It will be understood that the slot 21 is similarly provided with a capacitor. This capacitor interconnects the two interrupted or cut portions 25 and 26 of a copper coating (to be described hereinbelow) of the wing element.

The central section of the wing section 11 may be mechanically connected to the fairing 16 by screws 27. Similarly, screws 28 and 30 are provided at the outer portions or hinges of the wing element for connecting it to the leg elements 14 and 15.

As clearly shown in FIG. 4, the central leg element 12 is also provided with a copper cladding 31 which, however, stops as shown at 32; that is, before it reaches the ground plane 17. The central leg portion 12 and fairing 16 are also provided with a leg slot 34 disposed below the wing element 11, which interrupts the copper cladding 31. A capacitor 35 is disposed in the slot 34 and interconnects the several portions of the cladding 31. The slot 34, together with the capacitor 35, acts as a resonant trap of the upper UHF band (225–400 MHz) of the communication antenna section. The slot 34 is shown more clearly in FIG. 3 and extends from the front or leading edge 36 of the fairing 16 but stops short of the trailing edge 37. The fairing 16 also has a lower edge 39 which is well spaced from the ground plane 17. Thus, FIG. 3 also clearly shows that the copper coating 38 of the fairing 16 stops short of the ground plane 17 to provide insulation.

The entire antenna 10 may have a polyurethane core covered with an outer fiberglass shell to provide an electrically insulating structure.

The outer leg elements 14 and 15 are not covered with an electrically conductive coating. Instead, each of the legs 14 and 15 is provided with a central conductive wire 40 extending from below the surface of the upper wing section 11 down to an output terminal 41. A pair of inductors 42 and 43 is interposed through the wire 40. Furthermore, a resistor 49 may be disposed between the lower end of the wire 40 and the ground plane 17 for impedance matching purposes. This resistor may have a resistance of 250 ohms.

The central leg element 12 may be provided with a variable impedance-matching network 44 to match impedance for the various communication bands to which the antenna responds.

The output may be obtained from the output terminals 41 and 45 for the outer leg elements 15 and 14 and from the terminal 46 for the central leg element 12. The output feeds into a 50 ohm unbalanced line.

The communication antenna section of the invention may be made to responds to three frequency ranges; that is, 30 to 88 mHz; 108 to 174 mHz; and 225 to 400 mHz. For the directional antenna, which may be used as a homing antenna, the frequency range may be 30 to 88 mHz.

By way of example, the antenna 10 may have a length, from the center of the outer legs 14 and 15, of 33.00 inches. Accordingly, the length between the center of the center leg 12 and one of the outer legs 14 or 15 is 16.50 inches. The entire height from the ground plane 17 to the top of the wing element 11 may be 13.00 inches. With these values, the gain for the homing frequency range is between −35 and −25 $dB_i$, indicating gain in dB versus a linear isotropic radiator. The voltage standing wave ratio for the communication antenna section is 2.5 to 1 maximum and for the homing antenna section is 5 to 1 maximum. The power for the three communication frequency ranges is, respectively, 40, 50, and 100 watts continuous wave maximum. The polarization is essentially vertical. The gain for the three frequency ranges of the communication antenna section is, respectively, −18 to −8 $dB_i$ minimum; −3 to −1 dB minimum, and −1 to +1 $dB_i$ minimum.

As pointed out before, the communication antenna section is a capacitive top-loaded monopole antenna. It includes the upper wing element 11 and the fairing 16. It should be noted that the surface area of the upper wing element 11 should be approximately twice that of the central leg element 12 and fairing 16. In operation, the radiation of the lower frequency range 30 to 88 mHz is reflected on to the respective wires 40 of the two outer leg elements 14 and 15 to enhance the response. Thus, it will be noted that the central leg element 12 also forms part of the directional antenna section which further includes leg elements 14 and 15.

Figure 5:
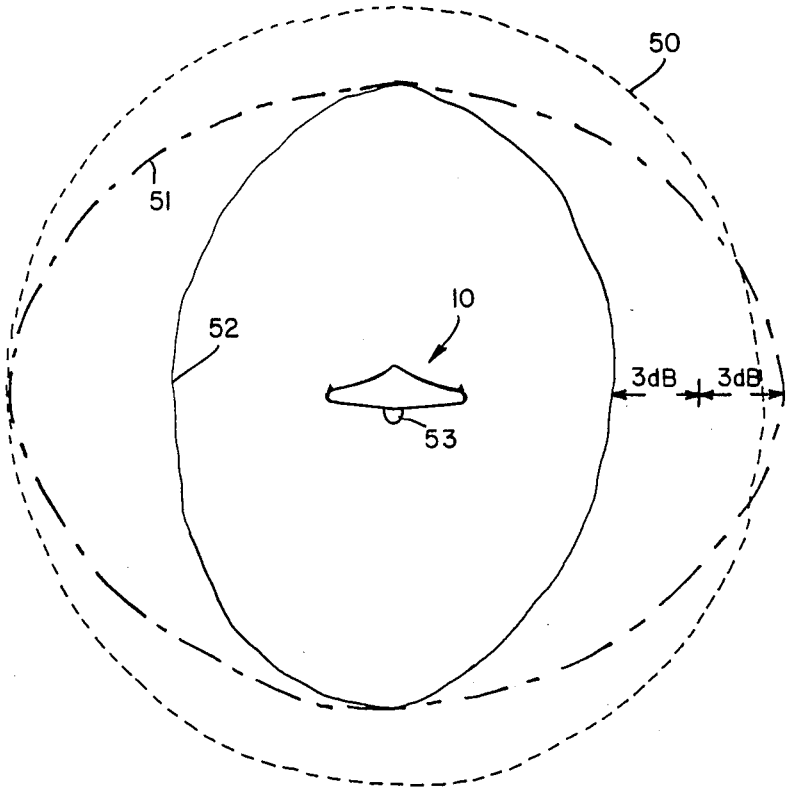
FIG. 5 is a graph illustrating the received radiation on polar coordinates of the communication portion of the antenna with its three frequency ranges.

FIG. 5, to which reference is now made, shows the response of the antenna 10 of the invention plotted on polar coordinates for, respectively, 80, 140, and 235 mHz, as illustrated by the curve 50 shown in dashed lines, curve 51 which is shown in dash-dot lines, and curve 52 which is shown in solid lines. The antenna 10 is oriented with its nose 53 forward. These responses show that the communication band at 235 mHz, curve 52, is somewhat shadowed by the outer leg elements 14 and 15. On the other hand, at 235 mHz, as shown by curve 51, the outer leg elements 14 and 15 act as directors and provide some gain off the sides of the array. Curve 50 shows that the low communication band, 80 mHz, is not materially affected by the outer leg elements 14 and 15.

Figure 6:
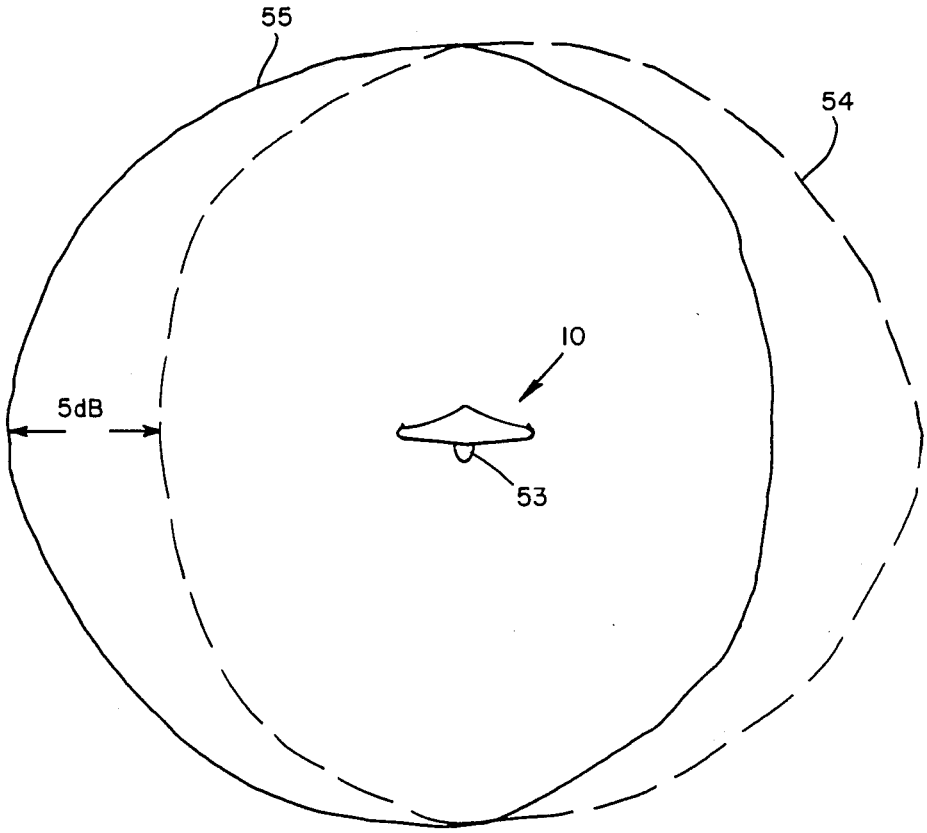
FIG. 6 is a similar polar coordinate diagram of the directional antenna portion of the device showing the left hand and right hand radiation output for the low frequency range of 30 mHz.
Figure 7:
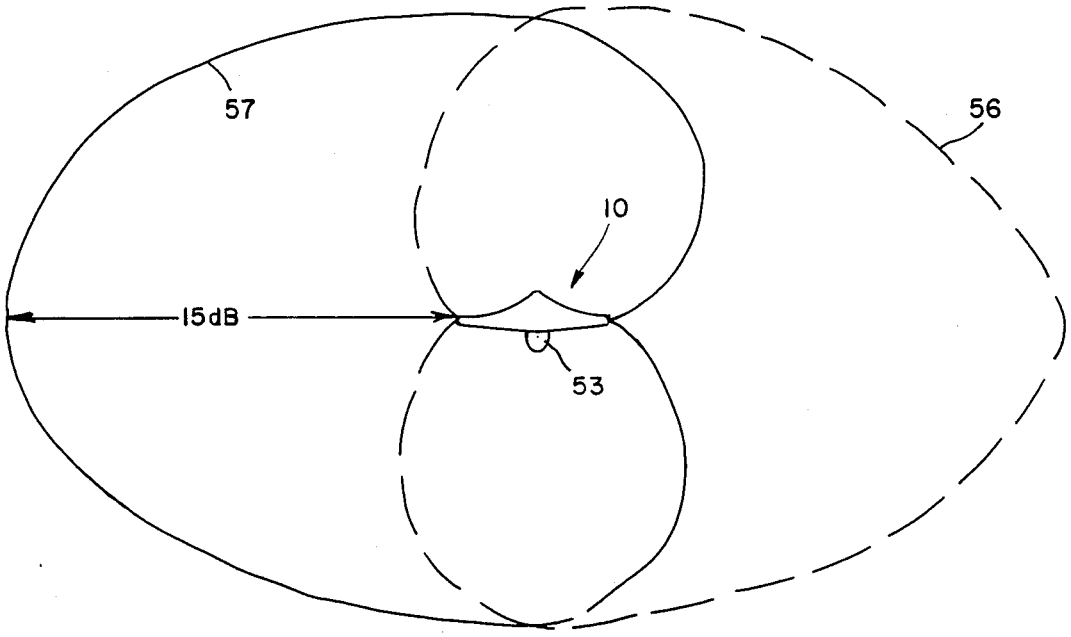
FIG. 7 is a similar polar coordinate graph for the frequency range of 50 mHz.
Figure 8:
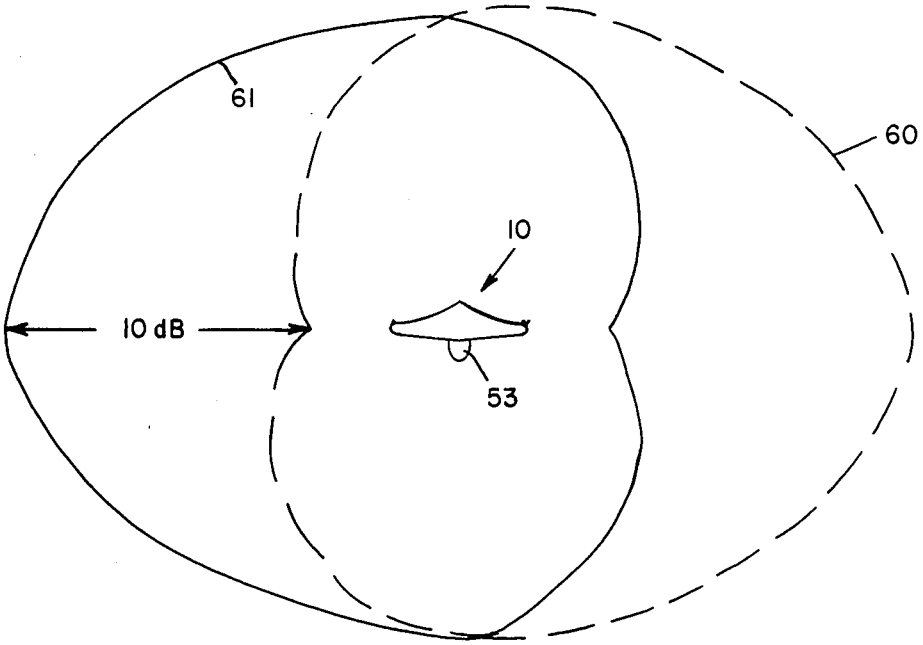
FIG. 8 is another polar coordinate diagram for the 85 mHz directional antenna response.

FIGS. 6 through 8 show the response of the directional antenna section to different frequencies. Thus, FIG. 6 shows the response at 30 mHz with the left-hand antenna output 54 in dashed lines, while the right-hand antenna output is shown by the solid line of curve 55. The difference between the two curves is shown on the left-hand side as 5 dB. This difference can be used for homing purposes.

Similarly, FIG. 7 illustrates the response of the homing antenna section at 50 mHz for the left-hand homing output 56 and the right-hand output 57, yielding a difference of 15 dB.

Finally, FIG. 8 shows the corresponding result for the homing antenna section at 85 mHz where, again, the left-hand output is shown at 60 and the right-hand output at 61, with a difference between the two of 10 dB.

If will be noted from FIGS. 6 to 8 that the signal amplitude ratio between the left-hand element and the right-hand element varies directly with increasing frequency and provides at least a 5 dB differential. The output may be used by utilizing the amplitude ratio or the phase difference. It will then be noted that the antenna of the invention corresponds to five different antennas; that is, three for the three communication ranges and two for the homing antenna section.

It will be noted that due to the capacitive top-loading the antenna will exhibit an effective height which is approximately twice its physical height. At 88 mHz the antenna has an effective height equivalent to a monopole antenna of 0.25 wavelength, while its physical height is only 0.1 wavelength. At 400 mHz the physical height of the antenna is more than 0.5 wavelength, so the trap formed by slot 34 together with capacitor 35 maintains essential equivalency electrically with a monopole of less than 0.5 wavelength. At 30 mHz the antenna has a physical height of only 0.034 wavelength but due to the capacitive top-loading, the effective height is nearly 0.08 wavelength.

There has thus been disclosed a multiband, multimode antenna suitable for use with an aircraft and capable of receiving communication signals within three separate wavelength bands, as well as within one directional frequency range, to provide a directional antenna section. The antenna is designed to be compact and suitable for installation on the surface of a fixed-wing airplane or a helicopter. It includes an upper wing element, two outer leg elements, a central leg element and a fairing extending below the wing element and forming part of the central leg element. All elements except the outer leg elements are coated with a conductive film such as copper, except for the lower portions of the fairing and central leg element, to provide insulation.

Two wing slots are provided extending parallel to the central axis through the wing element, as well as one leg slot extending through the central leg element and the fairing. The slots are provided with capacitors to provide antiresonant circuits to minimize response at certain frequency ranges. The outer leg elements receive by means of a central wire and their response is enhanced by reflection from the outer metal coating of the central leg element.

What is claimed is:

1. A multiband, multimode antenna suitable for use with an aircraft, said antenna comprising:

(a) an upper wing element;

(b) a central leg element mechanically connected to said wing element;

(c) a fairing extending below said wing element and connected to said central leg element, said upper wing, central leg element and said fairing constituting a monopole antenna section;

(d) a first outer leg element;

(e) a second outer leg element, said outer leg elements being substantially equally spaced from said central leg element and being mechanically connected to said wing element, said outer leg elements, in conjunction with said central leg element, constituting a directional antenna section;

(f) said elements consisting of an insulating material;

(g) an electrically conductive coating on the outer surface of said central leg and said wing elements and said fairing, except for the bottom area of said central leg element and said fairing, for insulation and for electrically connecting said elements and fairing; and (h) said outer leg elements being provided with an internal electrically conductive wire, whereby said central leg element will reflect electromagnetic radiation to said outer leg elements.

2. An antenna as defined in claim 1 wherein said electrically conductive coating consists of a copper layer.

3. An antenna as defined in claim 2 wherein said wing element has two wing slots extending therethrough from the leading edge of said wing element and to almost the trailing edge thereof, said slots being spaced from each other and substantially symmetrically located about a central axis passing through said wing section.

4. An antenna as defined in claim 3 wherein a capacitor is disposed in each of said wing slots adjacent said leading edge and interconnecting said copper layers cut by said wing slots, thereby to provide an antiresonant trap at a predetermined frequency range including said capacitor and wing slots.

5. An antenna as defined in claim 4 wherein said copper layer of said wing element forms a capacitive impedance for top loading said monopole antenna section and having approximately twice the surface area of that of said central leg portion and fairing.

6. An antenna as defined in claim 2 wherein said central leg element and said fairing have a leg slot disposed in the upper part thereof adjacent said wing element, and a capacitor bridging said slot and connected between the copper layers interrupted by said leg slot.

7. An antenna as defined in claim 2 wherein said conductive wires are each provided with a pair of inductors interposed between each of said wires and near the upper and lower ends thereof to provide a choke effect and to prevent resonance at the upper frequency range of said monopole antenna section.

8. An antenna as defined in claim 7 wherein a resistor is connected between a ground plane and the lower portion of each wire of said outer leg elements to match its impedance to that of an output line.

9. An antenna as defined in claim 6 wherein a variable impedance matching network is disposed at the bottom of said central leg slot to match impedance to selected frequency bands.

10. An antenna as defined in claim 1 wherein said insulating material consists of a polyurethane core and an outer fiberglass shell.

11. A multiband, multimode antenna suitable for use with an aircraft, said antenna comprising:

(a) an upper wing element including a fairing disposed beneath said wing element and mechanically connected thereto;

(b) a central leg element mechanically connected to said wing element, said upper wing element, fairing and central leg element constituting a monopole antenna section;

(c) a first outer leg element;

(d) a second outer leg element, said outer leg elements being substantially equally spaced from said central leg element and being mechanically connected to said wing element, said outer leg elements forming a directional antenna section;

(e) said elements consisting of an insulating material, said central leg element and said wing element being coated with an electrically conductive metal except for the bottom area of said central leg element and said fairing, for insulation from a ground plane;

(f) a first pair of wing slots extending from the leading edge of said wing element to near its trailing edge, said wing slots being substantially equally spaced from a central axis extending through said central leg element;

(g) a capacitor interconnecting the interrupted metal of said wing element adjacent the leading edge of said wing element and across each of said wing slots, the area of the metal of said wing element being substantially twice as large as the area of said fairing and central leg element;

(h) a conductive wire extending through each of said outer leg elements;

(i) a pair of inductors connected serially with each of said wires along the upper and lower portion of each of said outer leg elements, thereby to provide a choke and to prevent resonance at the upper range of said monopole antenna section;

(j) a leg slot disposed through said central leg element and fairing from the trailing edge of said antenna to near said leading edge;

(k) a capacitor interconnecting the interrupted metal of said central leg element and fairing near the trailing edge thereof to provide tuning;

(l) a terminating and impedance-matching resistor connected between the lower end of the wire of each of said outer leg portions and a ground plane; and (m) a variable impedance network coupled at the lower end of said central leg element for metching the impedance of various frequency bands to which said monopole antenna section is tunable, whereby said central leg element provides reflection of electromagnetic radiation for directional purposes onto said outer leg elements.

* * * * *